US005335038A

United States Patent [19]

Blackman et al.

[11] Patent Number: 5,335,038

[45] Date of Patent: Aug. 2, 1994

[54] METHOD AND APPARATUS FOR PREPARING A PHOTOGRAPHIC FILMSTRIP FOR PROCESSING IN A PHOTO FINISHING APPARATUS

[75] Inventors: Robert J. Blackman, Rochester; William J. Greene, Webster; Newton C. M. Landis, Penfield, all of N.Y.

[73] Assignee: Eastman Kodak Company, Rochester, N.Y.

[21] Appl. No.: 53,757

[22] Filed: Apr. 29, 1993

[51] Int. Cl.[5] ..... G03D 3/08

[52] U.S. Cl. ..... 354/319

[58] Field of Search ..... 354/318–320; 264/160, 345, 346, 285, 235, 210; 162/197, 271; 430/502

[56] References Cited

U.S. PATENT DOCUMENTS

| | | | |
|---|---|---|---|
| 3,002,222 | 10/1961 | Sevison | 264/345 |
| 3,552,668 | 1/1971 | Kanno | 242/55 |
| 3,806,574 | 4/1974 | Arvidson, Jr. | 264/160 |
| 3,939,000 | 2/1976 | Arvidson, Jr. et al. | 430/502 |
| 4,110,774 | 8/1978 | Krehbiel et al. | 354/345 |
| 4,259,008 | 3/1981 | Yamagata et al. | 355/29 |
| 4,574,692 | 3/1986 | Wahli | 355/40 X |
| 4,731,628 | 3/1988 | Uenaka et al. | 354/319 |
| 4,786,006 | 11/1988 | White et al. | 242 H/67.3 |
| 4,797,698 | 1/1989 | Uenaka et al. | 354/275 |
| 4,831,401 | 5/1989 | Uchiyama et al. | 354/319 |
| 4,843,412 | 6/1989 | Uchiyama et al. | 354/275 |
| 4,853,742 | 8/1989 | Payrhammer et al. | 355/27 |
| 5,124,743 | 6/1992 | Shiota | 355/30 |
| 5,159,385 | 10/1992 | Imamura | 355/28 |

FOREIGN PATENT DOCUMENTS 1469000 3/1977 United Kingdom .

*Primary Examiner*—D. Rutledge

*Attorney, Agent, or Firm*—David A. Howley

[57] ABSTRACT

A photographic filmstrip is initially coiled about a spool inside a cartridge with a trailing film end portion secured to the spool and a leading film end portion being free. The filmstrip is advanced, leading film end portion first, from the supply cartridge into a host container such that the filmstrip is reverse coiled in the host container to reduce any longitudinal curl in the filmstrip resulting from the filmstrip being wound on the spool. The trailing film end portion is released from the spool. The film in the host container can be heated to further reduce the longitudinal curl in the filmstrip.

15 Claims, 5 Drawing Sheets

METHOD AND APPARATUS FOR PREPARING A PHOTOGRAPHIC FILMSTRIP FOR PROCESSING IN A PHOTO FINISHING APPARATUS

CROSS-REFERENCE TO RELATED APPLICATIONS

Reference is made to commonly assigned copending applications Ser. No. 08/036,606, entitled Photographic Processing Apparatus, Ser. No. 08/036,563, entitled Film Extraction Unit, Ser. No. 08/036,18 entitled Flexible Guillotines and Ser. No. 08/036,313, entitled Film Length Checking Apparatus, all filed on Mar. 24, 1993 in the names of Pummell et al and all assigned to the assignee of the present application.

FIELD OF THE INVENTION

The invention relates generally to the field of photography, and more particularly to photo finishing apparatus. Specifically, the invention relates to a method and apparatus for preparing a photographic filmstrip for processing in a photo finishing apparatus.

BACKGROUND OF THE INVENTION

U.S. Pat. No. 4,797,698, issued on Jan. 10, 1989 in the names of Uenaka et al., discloses a film feeding apparatus for automatically feeding a negative film accommodated in a patrone to a developing machine. A multiplicity of magazines are piled one upon another with each magazine accommodating a patrone. The lowermost magazine is fed to a film receiving port of the developing machine. This magazine is retracted from the film receiving port so as to be discharged after the feed of the film has been completed. Consequently, the magazines are successively moved, and the films are thereby automatically fed to the developing machine.

The Uenaka reference is representative of film feeding apparatus which feed the lead end of a film first into a photo finishing machine. As discussed below, feeding a film leading end first into a photo finishing machine can cause problems when the film has taken on a core set due to being wound on a small core for an extended period of time.

PROBLEMS TO BE SOLVED BY THE INVENTION

The desire to reduce the size of photographic cameras results in a need to reduce the size of the photographic film coil in the film cartridge. Typically, film is wound on a core located inside a cartridge. One way to reduce the size of the film is to wind the film coil on a smaller core. However, as core diameters get smaller, say under 10 mm, core set problems start to occur. Core set is a tendency of the film to curl in a longitudinal direction when stored on a small core for extended periods of time. Core set gets progressively worse from the leading end to the trailing end of the film because the film closest to the core has the smallest circumference wrap on the core.

Films having a polyethylene terepthalate (PET) base are especially susceptible to core set problems during film processing because the core set is not appreciably removed by the water-based solutions used in processing the film. Additionally, core set problems are especially troublesome when the lead end of the film is fed first into a photo finishing apparatus.

FIGS. 1–4 display some of the problems which can occur when a film, having core set, is fed lead end first through a film processor. FIG. 1 shows a pair of pinch rollers 10 located at the front end of a film processor. The pinch rollers draw the film out of its cartridge and into the film processor. After passing around a guide roller 12 the film 14 enters a first developer tank 16 containing a developer fluid 18. As a trailing end portion 20 of the film leaves pinch rollers 10 it immediately curls up as it assumes the curled geometry in which it was kept on a core for several months or years. The trailing end portion tends to snap into the first developing tank which may leave a line of uneven development on the film. Also, because the curled trailing end portion of the film takes on several tightly wound convolutions as it proceeds into the first development tank, the developing fluid cannot evenly penetrate through these convolutions into the film emulsion, resulting in uneven development of the emulsion.

Referring to FIGS. 2 and 3, after the film has been processed in the developing fluids and dried it passes around a guide roller 22 and is pulled by another pair of pinch rollers 24 towards the end of the film processor. As the trailing end portion of the film approaches pinch rollers 24 it is unconstrained and again curls up in several tightly wound convolutions. The curled up trailing end portion of the film may be pulled en masse through pinch rollers which press the trailing end portion into several folds, thereby damaging the film.

With reference to FIG. 4, at any time after the trail end of the film is released from its film cartridge, the film may tend to curl, forming a "bird nest" 26 because the film is no longer under tension. This bird nesting of the film tends to interfere with the smooth pull of the film through the processor which results in slack being put into the film. This slack in the film through the processor causes the film to deviate from a straight path or meander, causing difficulty in processing the film. For example, if a bird nest forms in the drier before the film emulsion is completely dry, the film emulsion may stick to the back of the film or parts of the drier and be damaged.

SUMMARY OF THE INVENTION

According to one aspect of the invention, a photographic filmstrip is prepared for processing in a photo finishing apparatus. The filmstrip is initially coiled about a spool inside a cartridge with a trailing film end portion secured to the spool and a leading film end portion being free. The filmstrip is advanced, leading film end portion first, from the supply cartridge into a host container such that the filmstrip is reverse coiled in the host container to reduce any longitudinal curl in the filmstrip resulting from the filmstrip being wound on the spool. The trailing film end portion is released from the spool.

According to another aspect of the invention, the filmstrip is heated, while located in the host container, to a temperature and for a time sufficient to further reduce any longitudinal curl in the filmstrip resulting from the filmstrip being wound on the supply cartridge spool.

ADVANTAGEOUS EFFECTS OF THE INVENTION

An advantage offered by the invention is that the core set induced curl of the film is reduced by reverse coiling the film in the host container. In a preferred embodiment of the invention the curl of the film is further reduced by heating the film while it is in the host container. By reducing the curl in the film the above described problems are concomitantly reduced.

A further advantage of the invention is realized by feeding a trailing end portion of the film first into a photo finishing apparatus. When a leader card is attached to the trail end of the film, the trail end of the film, which typically has the worst curling problems, will not curl up. The lead end of the film now trails through the photo finishing apparatus. Because the lead end has much less core set induced curl than the trail end, the above described problems are greatly reduced.

DETAILED DESCRIPTION OF THE PREFERRED EMBODIMENTS

The description which follows is directed in particular only to those elements forming part of or cooperating directly with the disclosed embodiment. It is to be understood, however, that other elements may take various forms known to a person of ordinary skill in the art.

Figure 1:
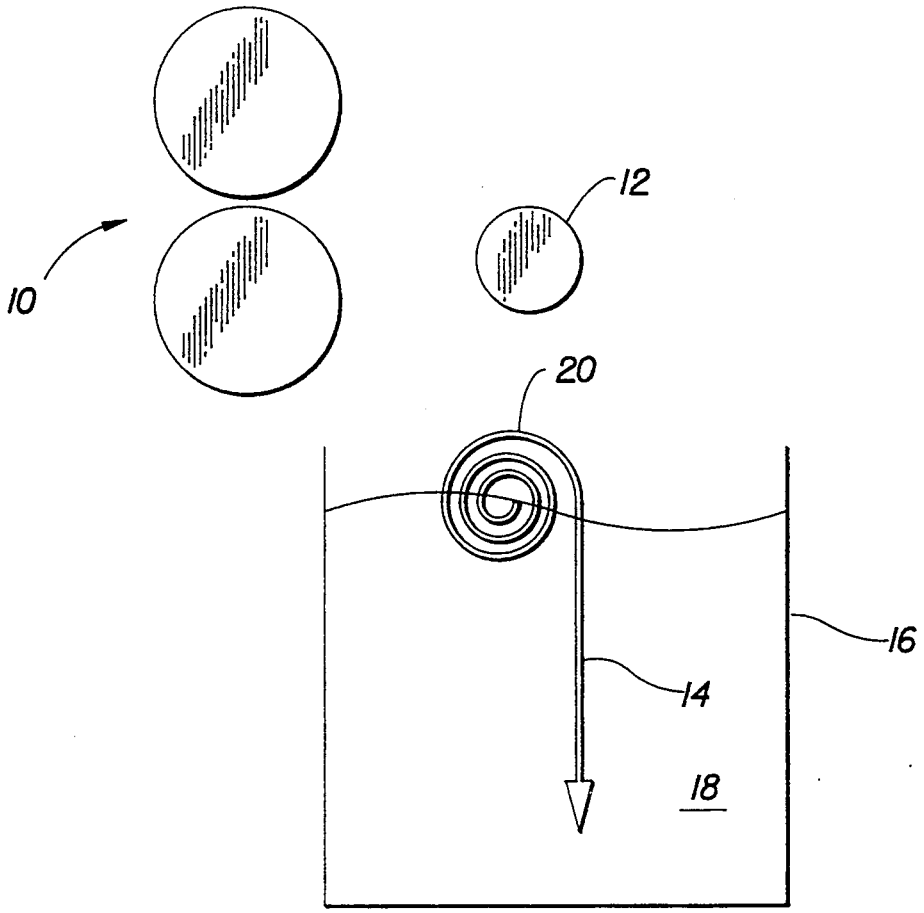
FIG. 1 (PRIOR ART)
FIG. 1 is a side view of an entrance portion of a prior art photofinishing apparatus.
Figure 2:
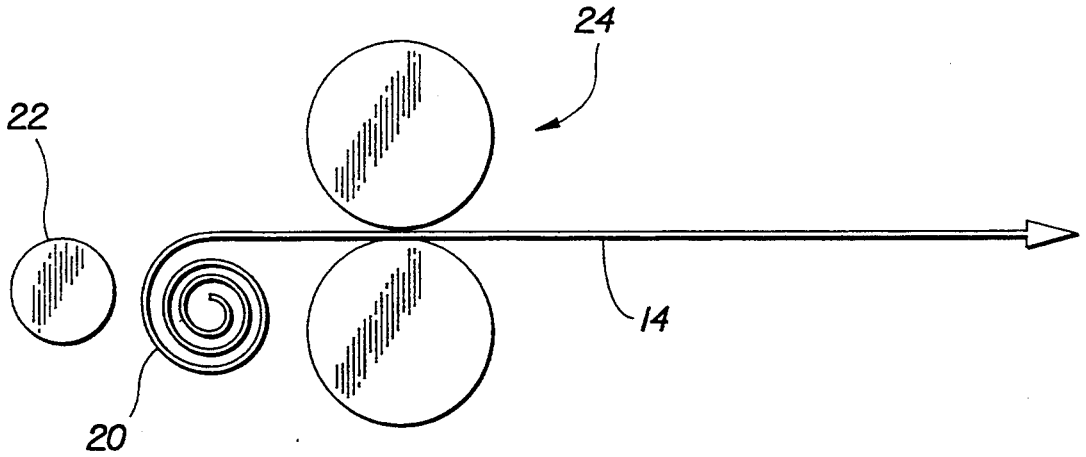
FIG. 2 (PRIOR ART)
FIG. 2 is a side view of an exit portion of a prior art photofinishing apparatus.
Figure 3:
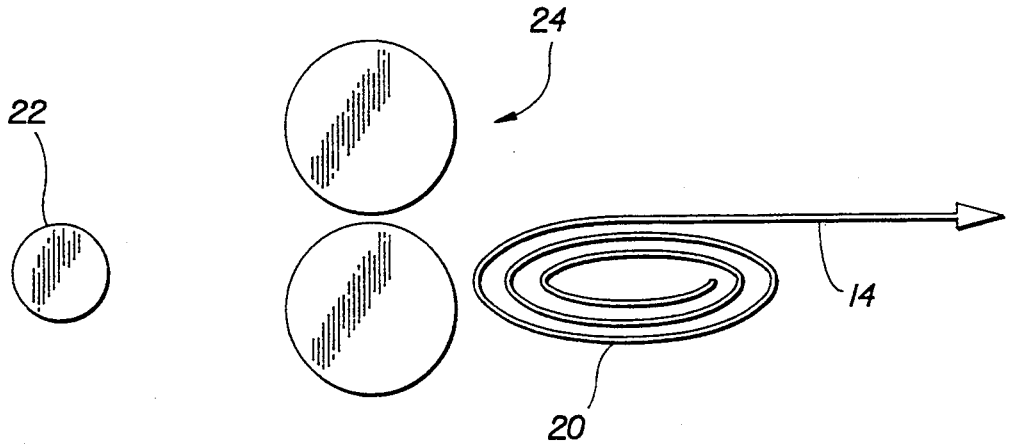
FIG. 3 (PRIOR ART)
FIG. 3 is a side view of an exit portion of a prior art photofinishing apparatus.
Figure 4:
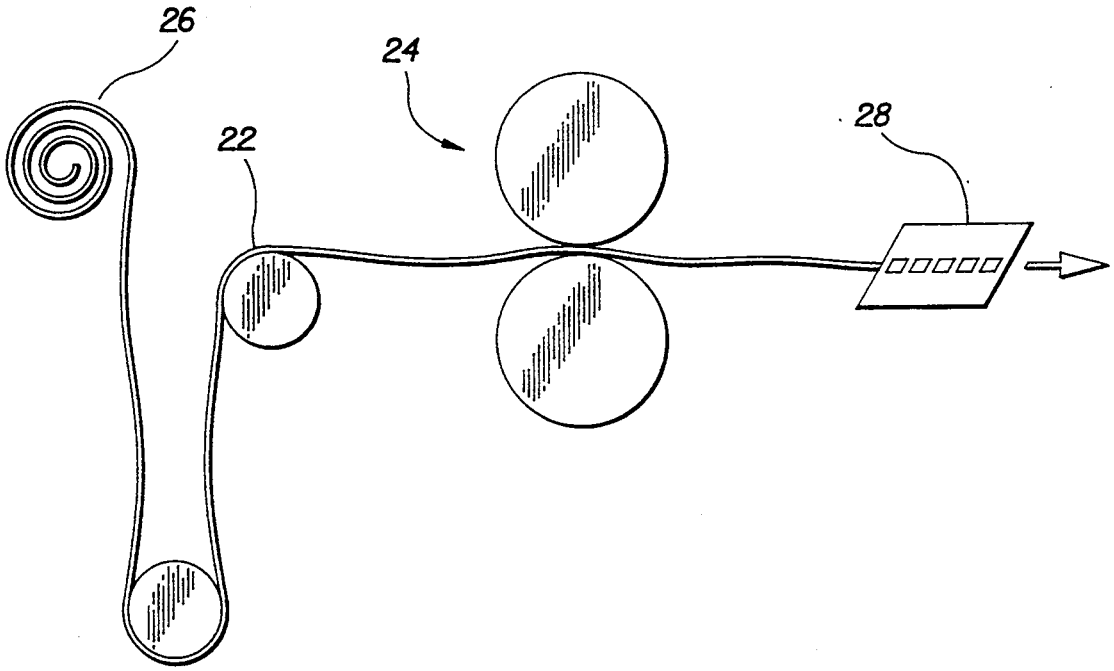
FIG. 4 (PRIOR ART)
FIG. 4 is a side view of an exit portion of a prior art photofinishing apparatus.
Figure 5:
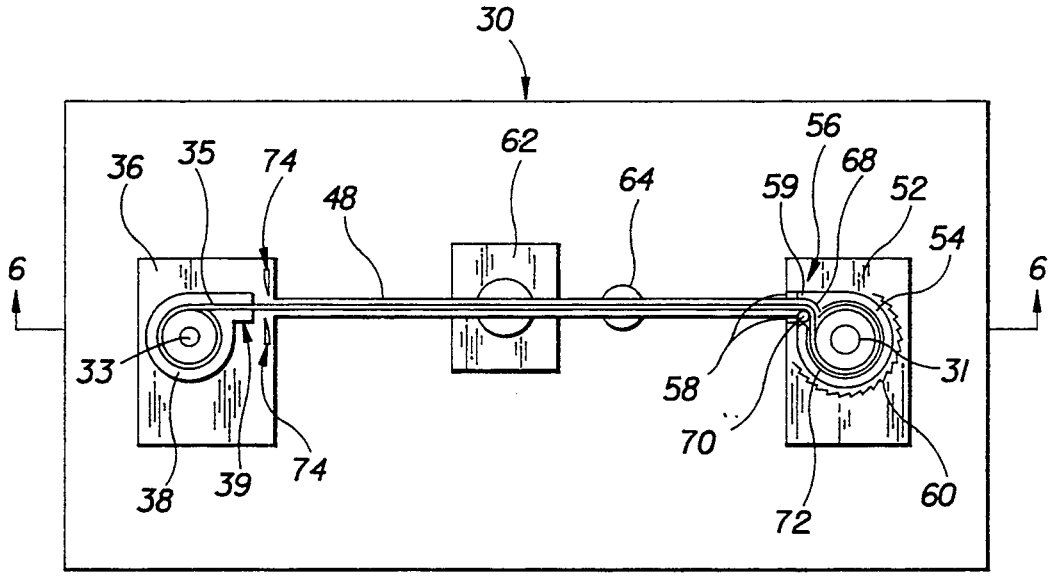
FIG. 5 is a side view of an apparatus for preparing film for a photofinishing operation.
Figure 6:
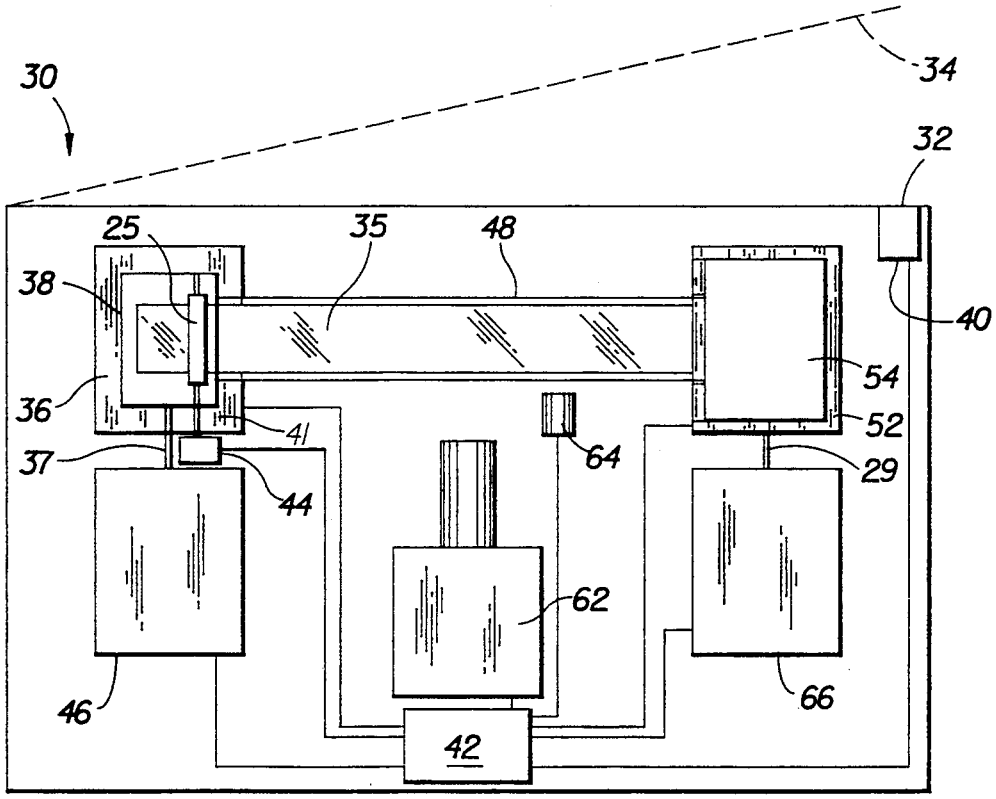
FIG. 6 is a top sectional view of the apparatus of FIG. 5 taken along the lines 6—6 of FIG. 5.

Referring now to the drawings, FIGS. 5–6 show a light-tight box designated generally by the reference numeral 30. One side of box 30 defines a door 32. Door 32 is hinged, allowing the door to be swung open, thereby granting access to the interior of box 30. Door 32 is represented in a partially open position by dashed line 34. The interior of box 30 supports a nest 36. Nest 36 defines a hollow space having a cross-section similar to a cross-section of a film supply cartridge 38. The film supply cartridge is inserted into the hollow space in the nest through a side of the nest which faces the door. When cartridge 38 is inserted into the hollow space the cartridge is securely held in place.

Cartridge 38 contains a photographic filmstrip 35 coiled about a spool 33 located inside the cartridge. Typically, the filmstrip would be wound on the spool with the emulsion side of the filmstrip facing in. A trailing film end portion is secured to the spool with a leading film end portion being free. When the cartridge is in the nest the cartridge spool is engaged by a motor drive shaft 37 while a light lock door 25 (shown in an open position in FIG. 6), located in a lip 39 of the cartridge, is engaged by a solenoid drive shaft 41.

A second nest 52 defines a hollow space having a cross-section similar to a cross-section of a host container 54. The host container is inserted into the hollow space of nest 52 through a side of nest 52 which faces door 32. When container 54 is inserted in the hollow space in nest 52 the host container is securely held in place and a spool 31 is engaged by a motor drive shaft 29. Preferably spool 31 has a diameter of about 13 mm or less. Preferably the host container has an external shape similar to a film cartridge designed to be processed by certain photo finishing equipment (described later). More preferably, the host container has an external shape similar to a 35 mm film cartridge. A lip 56 of the host container contains a plush 58 which acts as a passive light lock. A top portion 59 of lip 56 is hinged and is shown in an open position in FIG. 5. The top portion of the lip is held in the open position by a mechanism such as a compression spring in the host container.

It is preferred that the host container be heated to a temperature of between about 40 to 100 degrees centigrade, preferably 80 degrees centigrade, prior to receiving film. The host container may be heated in an oven prior to being inserted in the nest or may be heated after being inserted in the nest by heating element 60. When heating element 60 is used to heat the host container, the heating element is preferably shut off once the host container reaches the desired temperature.

The closing of door 32 actuates a switch/lock 40 which indicates to a logic and control (LCU) unit 42 that the door has been closed. When the LCU senses that a supply cartridge and host container have been loaded into their respective nests the LCU instructs the switch/lock to lock door 32 in a closed position. If either the host container or supply cartridge is missing the LCU will instruct the operator to load the missing component. Once door 32 is locked, LCU 42 actuates a solenoid 44 which, through solenoid drive shaft 41, opens the light lock door in lip 39. Now LCU 42 actuates a thrust motor 46 which, through drive shaft 37, rotates the cartridge spool. Rotation of the cartridge spool causes a forward end of the leading end portion of the film to be thrust through lip 39 past the open light lock door into a film raceway 48.

Figure 7:
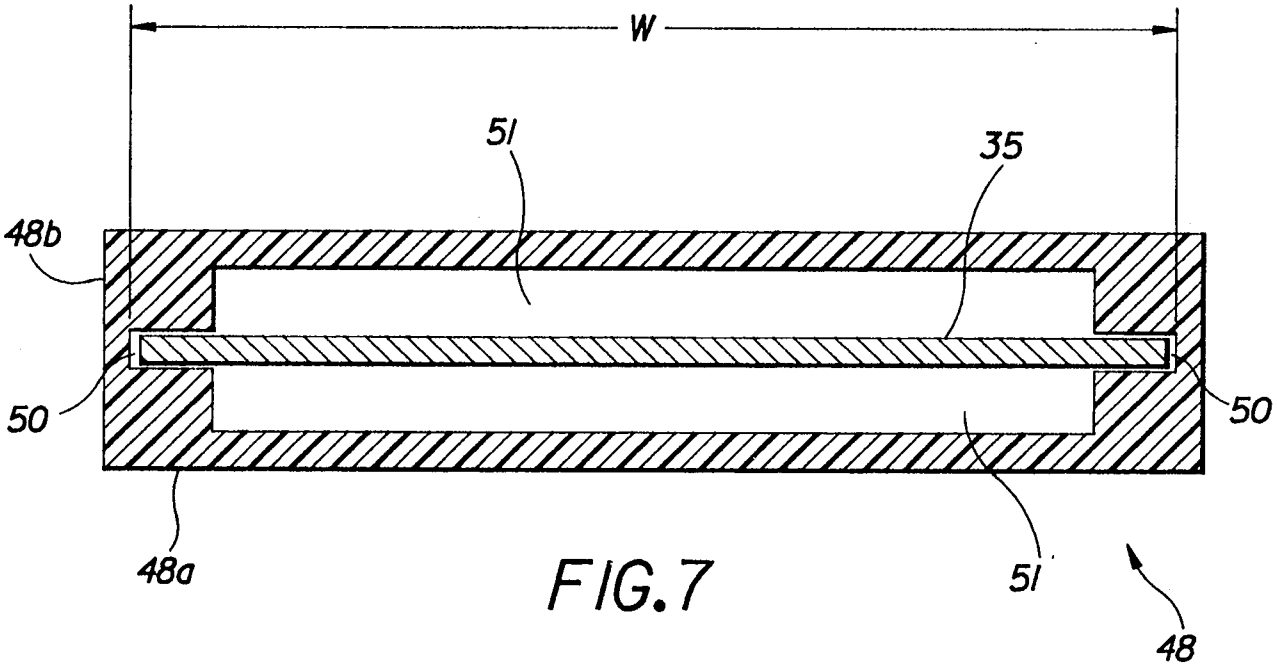
FIG. 7 is a cross-sectional view of a film raceway.

Referring to FIG. 7, film raceway 48 includes a lower portion **48*a* and an upper portion 48*b*. A width W of the raceway is only slightly wider than the film width. Portions 48*a* and 48*b* define a pair of spaces 50 which are only slightly thicker than film 35. As the film travels down raceway 48 only the film's non-image edges will contact the raceway in the vicinity of spaces 50. The imaged areas of the film will not contact the raceway as these areas are located in hollow space 51** of the raceway.

Referring again to FIGS. 5 and 6, the film travels along raceway 48 to second nest 52. An optional heated air blower 62 blows hot air through small openings in the side of the raceway to preheat the film prior to the film reaching nest 52. A sensor 64, which looks through a small opening in the side of raceway 48, indicates to the LCU when the lead end of the film has reached the sensor. The LCU in turn starts a motor 66 which, through drive shaft 29, rotates spool 31. When the lead end of the film reaches the host container a pair of film deflectors 68 and a pair of rollers 70 (one deflector and roller are hidden from view) combine to deflect the lead end portion of the film in a downward direction. The film deflectors and rollers contact the film only along its edge portions similar to where the raceway contacts the film.

A pair of film guides 72 (one is hidden from view) contact the edge portions of the film and, in combination with rotating spool 31, guide the lead end of the film such that the film is reverse coiled inside the host container. The film guides are preferably made of spring steel and are initially in close proximity to spool 31. As the film wraps up on spool 31, the film guides will flex away from the spool as they simultaneously press the film against the spool. The film is reverse wound on spool 31 which assists in removing core set induced curl in the film.

When the film has been completely fed from the supply cartridge into the host container the film will be stretched taught because the trail end of the film is preferably secured to the core of the supply cartridge. As a result motor 66 will not be able to rotate spool 31. When LCU 42 detects that motor 66 has stopped rotating its drive shaft, the LCU actuates a mechanism to detach the end of the film from the core. Alternatively, a cutting device 74 may be used to cut the trailing end portion of the film from core 33. LCU 42 then shuts off motor 46. The trail end of the film is pulled through raceway 48 by motor 66. When sensor 64 detects the trail end of the film has passed the sensor, LCU 42 shuts Off motor 66 such that the trail end portion of the film, not containing any images, remains outside the lip of host container 54.

The LCU actuates a mechanism such as an air cylinder 76 which impacts the top hinged portion 59 of lip 56 causing the top hinged portion to close. Portion 59 is held in a closed position by a detent (not shown) in the lip. With portion 59 in a closed position plush 58 snugly engages the trailing end portion of the film, locking out any light from the inside of the host container. The LCU then unlocks door 32.

The film should remain in the host container for between about 30 seconds and six minutes, preferably four minutes when the host container was initially heated to a temperature of about 80 degrees centigrade. The host container can remain in its nest or be removed from its nest to be placed in a queue for further photofinishing steps.

Figure 8:
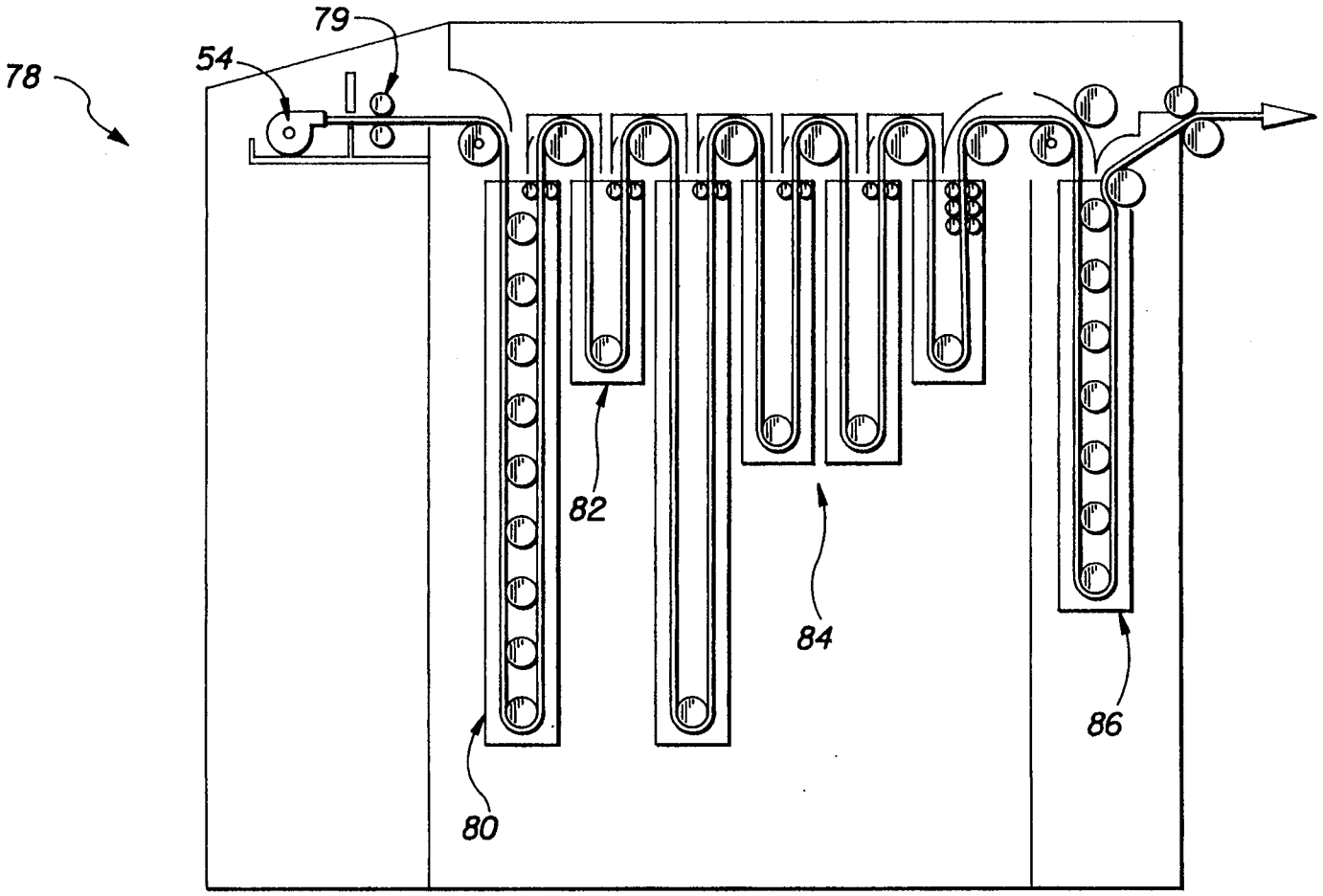
FIG. 8 is a schematic illustration of a photo finishing apparatus.

Referring to FIG. 8, the operator then places the host container in a photofinishing apparatus such as a film processor 78. The film in host container 54 is then processed by steps well known in the art. Briefly, a leader card is attached to the trail end portion of the film either automatically or by an operator. The film is then advanced through a pair of rollers 79, a developing tank 80, a fixing tank 82 and one or more rinsing tanks 84. Finally, the film is dried in a drier 86 and exited from the film processor.

The invention has been described with reference to preferred embodiments. However, it will be appreciated that variations and modifications can be effected by a person of ordinary skill in the art without departing from the scope of the invention.

| Parts List for FIGS. 1–9 | |
|---|---|
| 10 | pinch rollers |
| 12 | guide rollers |
| 14 | film |
| 16 | developer tank |
| 18 | developer fluid |
| 20 | film trailing end portion |
| 22 | guide roller |
| 24 | pinch rollers |
| 25 | light lock door |
| 26 | bird nest |
| 28 | leader card |
| 29 | motor drive shaft |
| 30 | light-tight box |
| 31 | spool |
| 32 | door |
| 33 | spool |

-continued

| Parts List for FIGS. 1–9 | |
|---|---|
| 34 | dashed line |
| 36 | nest |
| 38 | film supply cartridge |
| 40 | switch/lock |
| 42 | logic and control unit |
| 44 | solenoid |
| 46 | thrust motor |
| 48 | film raceway |
| 48a | lower portion |
| 48b | upper portion |
| 50 | spaces |
| 51 | hollow space |
| 52 | nest |
| 54 | host container |
| 56 | lip |
| 58 | plush |
| 59 | lip top portion |
| 60 | heating element |
| 62 | heated air blower |
| 64 | sensor |
| 66 | motor |
| 68 | film deflectors |
| 70 | rollers |
| 72 | film guides |
| 74 | cutting device |
| 76 | air cylinder |
| 79 | rollers |
| 80 | developing tank |
| 82 | fixing tank |
| 84 | rinsing tanks |
| 86 | drier |
| 35 | photographic filmstrip |
| 37 | motor drive shaft |
| 39 | cartridge lip |
| 41 | solenoid drive shaft |

What is claimed is:

1. A method of transferring a photographic filmstrip from a film supply cartridge to a photo finishing apparatus, wherein the filmstrip is initially coiled about a spool inside the cartridge with a trailing film end portion secured to the spool and a leading film end portion being free, said method comprising the steps of:

advancing the filmstrip, leading film end portion first, from the supply cartridge into a host container;

reverse coiling the filmstrip, leading film end portion first, inside said host container to reduce any longitudinal curl in said filmstrip resulting from the filmstrip being wound on said spool; and releasing the trailing film end portion from the spool.

2. The method of claim 1, further comprising the step of:

advancing the filmstrip, trailing film end portion first, from the host container to a photo finishing apparatus.

3. The method of claim 1 wherein said step of reverse coiling the filmstrip inside the host container includes the step of reverse winding said filmstrip onto a spool located in said host container.

4. The method of claim 1, further comprising the step of heating said filmstrip, while located in said host Container, to a temperature and for a time sufficient to reduce any longitudinal curl in said filmstrip resulting from the filmstrip being wound on said spool.

5. The method of claim 4 wherein said heating step is carried out at a temperature of between about 40 and 100 degrees Celsius for between about 30 seconds and six minutes.

6. The method of claim 5 wherein said heating step is carried out at a temperature of about 80 degrees Celsius for about four minutes.

7. The method of claim 1 wherein said step of advancing the filmstrip from the supply cartridge to the host container includes the step of rotating said spool to thrust a forward end of the leading film end portion from the supply cartridge towards the host container.

8. Apparatus for transferring a photographic filmstrip from a film supply cartridge to a photo finishing apparatus, wherein the filmstrip is initially coiled about a spool inside the cartridge with a trailing film end portion secured to the spool and a leading film end portion being free, said apparatus comprising:

a host containers for the filmstrip, including means for reverse coiling the filmstrip, leading film end portion first, inside said host container to reduce any longitudinal curl in said filmstrip resulting from the filmstrip being wound on said spool;

means for advancing the filmstrip, leading film end portion first, from the supply cartridge into said host container; and means for releasing the trailing film end portion from the spool.

9. The apparatus of claim 8, further comprising:

means for advancing the filmstrip, trailing film end portion first, from the host container to a photo finishing apparatus.

10. The apparatus of claim 8 wherein said host container includes a spool and said reverse coiling means is effective to reverse wind said filmstrip onto said spool located in said host container.

11. The apparatus of claim 10 wherein said host container spool has a diameter of about 13 mm or less to further reduce any longitudinal curl in said filmstrip resulting from the filmstrip being wound on said spool.

12. The apparatus of claim 8, further comprising:

means for heating said filmstrip, while located in said host container, to a temperature and for a time sufficient to reduce any longitudinal curl in said filmstrip resulting from the filmstrip being wound on said spool.

13. The apparatus of claim 12 wherein said heating means is effective to heat said filmstrip to a temperature of between about 40 and 100 degrees Celsius for between about 30 seconds and 6 minutes.

14. The apparatus of claim 13 wherein said heating means heats said film to a temperature of about 80 degrees Celsius for about 4 minutes.

15. The apparatus of claim 8 wherein said means for advancing the filmstrip from the supply cartridge to the host container includes means for rotating said supply cartridge spool to thrust a forward end of the leading film end portion from the supply cartridge towards the host container.

* * * * *